US006308832B1

(12) United States Patent
Pirro et al.

(10) Patent No.: US 6,308,832 B1
(45) Date of Patent: Oct. 30, 2001

(54) PRODUCT DISPLAY PACKAGE

(75) Inventors: Jeffrey P. Pirro, Marcellus, NY (US); Julio C. Casanova, Avon Lake, OH (US); Wayne E. Uren, Chesterfield, MO (US); Mark A. Ferguson, Syracuse, NY (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 09/410,525

(22) Filed: Oct. 1, 1999

(51) Int. Cl.[7] ..... B65D 73/00
(52) U.S. Cl. ..... 206/469; 206/470; 206/462
(58) Field of Search ..... 206/462, 469, 206/470, 703, 705, 775, 779, 461

(56) References Cited

U.S. PATENT DOCUMENTS

| | | | | |
|---|---|---|---|---|
| 2,993,590 | * | 7/1961 | Denton . | |
| 3,111,220 | * | 11/1963 | Bostrom . | |
| 3,635,331 | | 1/1972 | Zucker | 206/45.34 |
| 3,666,087 | * | 5/1972 | Cooper . | |
| 4,456,124 | | 6/1984 | Kay et al. | 206/463 |
| 4,694,960 | | 9/1987 | Phipps et al. | 206/469 |
| 4,784,268 | | 11/1988 | Perchak | 206/461 |
| 4,899,882 | | 2/1990 | Benner | 206/470 |
| 5,209,354 | | 5/1993 | Thornhill et al. | 206/469 |
| 5,456,382 | | 10/1995 | Gringer | 221/252 |
| 5,699,913 | * | 12/1997 | Richardson | 206/470 |
| 5,899,333 | * | 5/1999 | Williams et al. | 206/469 |

OTHER PUBLICATIONS

Techform, Inc. 20 Years of Creative Custom Thermoforming, brochure, Nov. 1982.*

* cited by examiner

*Primary Examiner*—David T. Fidei
(74) *Attorney, Agent, or Firm*—Stewart A. Fraser

(57) ABSTRACT

A display package for retaining product includes a reclosable container having a housing defining a compartment adapted to house product therein and a lid for engaging the housing to close the compartment. The package also includes a display card having a planar main body and being integrally formed to engage and support the container. A tear section is formed in the display card and is adapted to allow for removal of the container from the display card. Once removed from the display card, the reclosable container may be used without the display card to house the product.

72 Claims, 4 Drawing Sheets

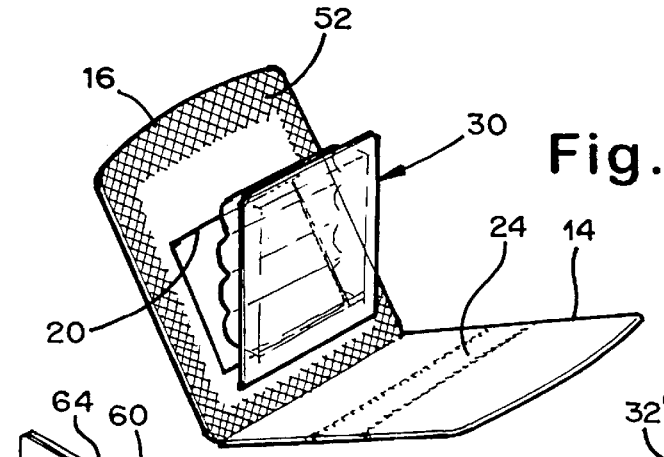
Fig. 15
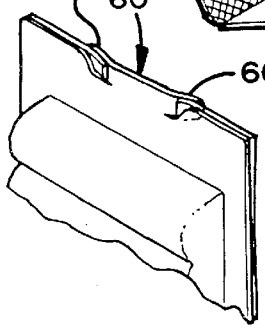
Fig. 12
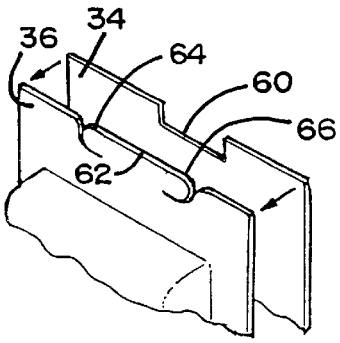
Fig. 11
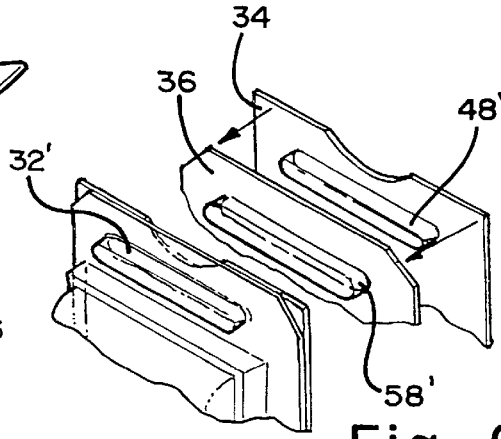
Fig. 10
Fig. 9
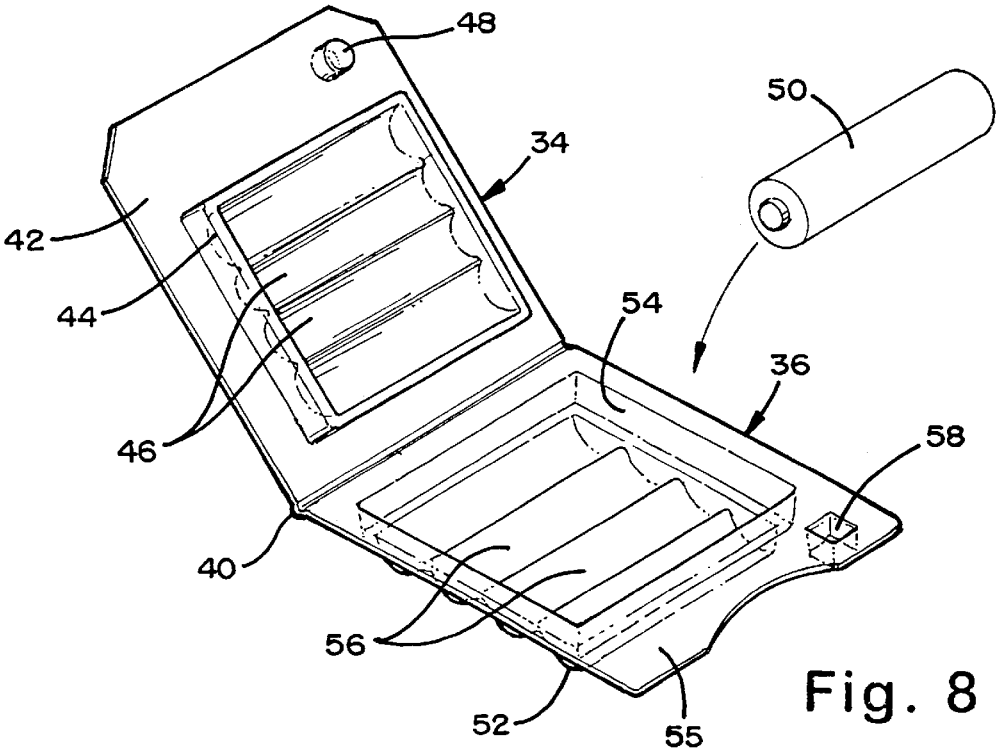
Fig. 8

PRODUCT DISPLAY PACKAGE

BACKGROUND OF THE INVENTION

The present invention generally relates to packages for displaying product for sale and, more particularly, to a display package having a combined display card and container for containing product for display to consumers.

The common practice for displaying small and lightweight retail items, such as alkaline batteries, is to package the items in thermoformed blister packages and place the packages on shelves or hang the packages on hooks on various display racks. The conventional battery package is composed of a display card which provides a generally stiff supportive backing, usually composed of cardboard, and a thermoformed polymeric blister that is bonded to the display card. The display card provides support for displaying the merchandise for sale and contains print with suitable indicia such as advertising and instructions. The thermoformed blister generally comprises two pieces of clear polymeric material, e.g., plastic, that are held together to define a cavity, generally having a shape to fit over and cover the product(s) contained within the package. The blister isolates the product(s) from the purchaser and prevents inadvertent damage that can result from repeated handling prior to sale, while further allowing for the orderly display of product(s) for sale to purchasers.

With battery display packages, batteries of the same size are commonly made available to consumers for purchase in a package containing a predetermined number of batteries. The batteries are displayed and sold in blister type packages which usually contain two, four, or eight batteries commonly packaged in each display package. According to one approach, the blister is heat sealed on one side of the cardboard display card. According to another approach, the display card is made of two layers of cardboard with an aperture formed therein. The polymeric blister typically has two pieces, each having a peripheral flange glued between the two layers of cardboard of the display card. Additionally, each display package typically has a through-hole formed in the display card near the top so that the package can be hung on a hook on a display stand in a retail store for display to consumers.

While the aforementioned conventional blister packages for batteries have significant advantages over other conventional product packaging approaches, they possess some inherent disadvantages. To prominently display the products and also decrease the probability of shoplifting, the blister package is relatively large in comparison to some of the products contained therein. Additionally, it is often difficult for the purchaser to gain access to the contents contained in the blister package. With a conventional display card, the card is generally torn open to access the two pieces of polymeric blister which are then separated to expose the products. However, once the package is opened, it is generally no longer conveniently useful for storing batteries or other products, and instead is intended to be discarded. Particularly, when purchasing a package containing a large number of batteries, it becomes even more problematic to store the non-used batteries once the blister package is opened.

Accordingly, there is a need, heretofore unfulfilled, for a relatively inexpensive product display package for displaying products for sale to consumers in a manner that offers reusable product storage. It is further desirable to provide for such a product display package that offers the capability to conveniently store product in a reduced package size.

SUMMARY OF THE INVENTION

The present invention provides a product display package that is easy to access and allows for a reusable storage housing. To achieve this and other advantages, and in accordance with the purpose of the present invention as embodied and described herein, the present invention provides for a product display package for retaining product. According to one aspect of the present invention, the package includes a reclosable container having a housing defining a compartment adapted to house product and a lid for engaging the housing to close the compartment. The package also includes a display card having a main body and is integrally formed to engage and support the container. A tear section is formed in the display card and is adapted to allow for removal of the container from the display card. Once removed from the display card, the reclosable container may be used without the display card, and may be easily reused to house product.

According to another aspect of the present invention, a display package for retaining product is provided comprising a reclosable container having a housing defining a compartment adapted to house product and a closable lid fit to engage the housing and close the compartment. The container has a peripheral flange extending outward from the container. The package further includes a display card having a main body including a first layer of material attached to a second layer of material. The first layer of material has an aperture formed therein for receiving the container, and the flange of the container is disposed between the first and second layers of material to support the container.

According to a further aspect of the present invention, a display package is provided for retaining product comprising a container having a housing defining a compartment adapted to house product and a closable lid fit to engage the housing and close the compartment. The container has a peripheral flange formed outward from the container and further has a member that varies in width so that an upper width is greater than a lower width. The display package also includes a display card having a main body and including a first layer of material attached to a second layer of material. The first layer of material has an aperture formed therein for receiving the container. The flange of the container is disposed between the first and second layers of material to support the container. The member of the container may include a trapezoid shaped housing according to one embodiment, or a trapezoid shaped peripheral flange according to another embodiment. The greater upper width of the member acts like a wedge to prevent the container from being released from the display card due to weight of the product and/or abuse conditions.

These and other features, advantages and objects of the present invention will be further understood and appreciated by those skilled in the art by reference to the following specification, claims and appended drawings.

BRIEF DESCRIPTION OF THE DRAWINGS

In the drawings:

FIG. 8 is a perspective view of the merchandise container shown in the open position;

FIG. 9 is a partial perspective view of an open merchandise container having an alternative snap-fit closure according to another embodiment;

FIG. 10 is a partial perspective view of the closed merchandise container with the snap-fit closure shown in FIG. 9;

FIG. 11 is a partial perspective view of the open merchandise container having a locking tab fastener according to another closure embodiment;

FIG. 12 is a partial perspective view of the closed merchandise container with the locking tab closure shown in FIG. 11;

FIG. 15 is an assembly view illustrating the arrangement of the merchandise container and the display card;

DETAILED DESCRIPTION OF THE PREFERRED EMBODIMENTS

Figure 1:
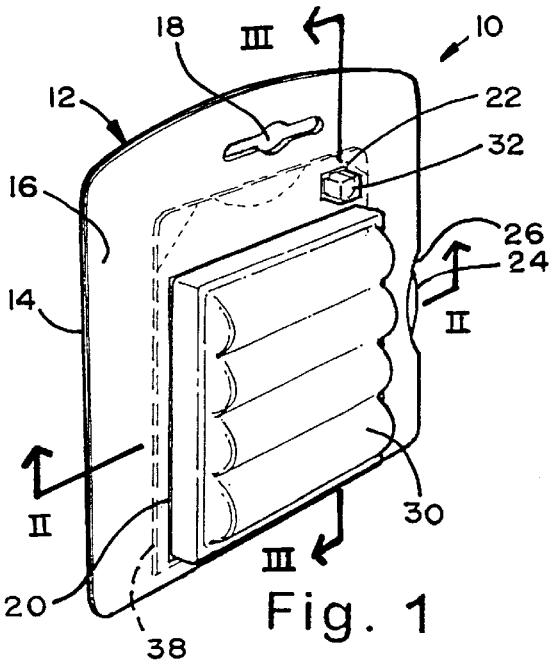
FIG. 1 is a front perspective view of a product display package according to one embodiment of the present invention.

For purposes of description herein, the terms "upper," "lower," "right," "left," "rear," "front," "vertical," "horizontal" and derivatives thereof shall relate to the invention as oriented in FIG. 1. However, it is to be understood that the invention may assume various alternative orientations and step sequences except where expressly specified to the contrary. It is also to be understood that the specific devices illustrated in the attached drawings, and described in the following specification are simply exemplary embodiments of the inventive concepts defined in the appended claims. Hence, specific dimensions and physical characteristics relating to the embodiments disclosed herein are not to be considered as limiting, unless the claims expressly state otherwise.

Referring to FIG. 1, a product display package 10 is shown for packaging a plurality of cylindrical batteries, such as AA-sized batteries, for display and sale to consumers in a retail store according to one embodiment. The product display package 10 shown houses four cylindrical AA-size batteries, according to one example, in a combination display card and reclosable merchandise container. While a battery package is shown and described herein, it should be appreciated that the present invention provides a product display package that may house products of various sizes, shapes, and numbers, which may include batteries as well as other types of products, without departing from the spirit of the present invention.

The product display package 10 generally includes a display card 12 having a substantially planar main body and a polymeric blister merchandise container 30 supported by the display card 12. The display card 12 is made up of two layers of material, including a rear layer of cardboard 14 bonded to a front layer of cardboard 16. Layers 14 and 16 may include two separate sheets of cardboard substantially similarly shaped and bonded together via glue. Alternately, layers 14 and 16 may be formed from a sheet piece of cardboard that is folded along one edge, such as the lower edge, and pressed and bonded together. Display card 12 generally includes a lower edge, two vertical side edges on the left and right sides, and an upper edge. Formed near the upper edge of display card 12 is a cutout aperture 18 which allows the display card 12 to be hung from a hook on a display rack. In addition, the display card 12 may contain print with indicia such as advertising and instructions.

The merchandise container 30 is a reclosable and reusable transparent thermoformed blister container that houses product, such as batteries. The merchandise container 30 has a peripheral flange 38 formed around the perimeter of the main housing compartment and extending radially outward. The peripheral flange 38 is sandwiched between the rear and front layers 14 and 16, respectively, of display card 12. Merchandise container 30 extends through an aperture 20 formed in the front layer 16 of display card 12. The peripheral flange 38 is sandwiched between rear and front layers 14 and 16, and preferably is not bonded to the display card 12. Accordingly, merchandise container 30 is trapped in place between the front and rear layers 14 and 16 of display card 12 prior to the display card 12 being torn open.

Merchandise container 30 also includes a snap-fit closure 32 which extends through an aperture 22 formed in the front layer 16 of display card 12. Snap-fit closure 32 provides an added interference fit closure to aid in holding the merchandise container 30 in its closed position. By extending the snap-fit closure 32 through aperture 22, it is visible and thereby serves to identify the merchandise container 30 as a reclosable container. Also shown is a tab 24 in layer 14 which partially extends from a cutout section 26 formed in the edge of front layer 16 of display card 12.

Figure 2:
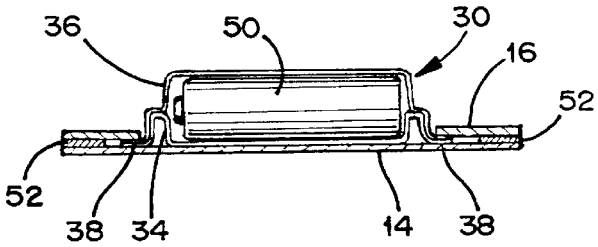
FIG. 2 is a cross-sectional view taken through lines II—II of FIG. 1.

Referring to FIG. 2, the product display package 10 has cardboard layers 14 and 16 of display card 12 bonded together via glue 52 at a region radially outward from the peripheral flange 38 of merchandise container 30. Accordingly, layers 14 and 16 sandwich peripheral flange 38 therebetween to secure the merchandise container 30 to display card 12, yet allow for the merchandise container 30 to be easily removed from the display card 12 once the display card 12 is torn open. The reclosable merchandise container 30 includes a base housing 34 which generally lies flat against the surface of rear layer 14 of display card 12, and a lid 36 which is shown closed against base housing 34 to define a closed compartment for containing product, such as batteries 50, within the merchandise container 30. The merchandise container 30 is preferably a polymeric thermoformed blister having a thickness in the range of approximately 0.2032–0.508 mm, and more preferably in the range of approximately 0.3048–0.381 mm, while the individual layers 14 and 16 of display card 12 have a thickness of approximately 0.4064 mm.

Figure 3:
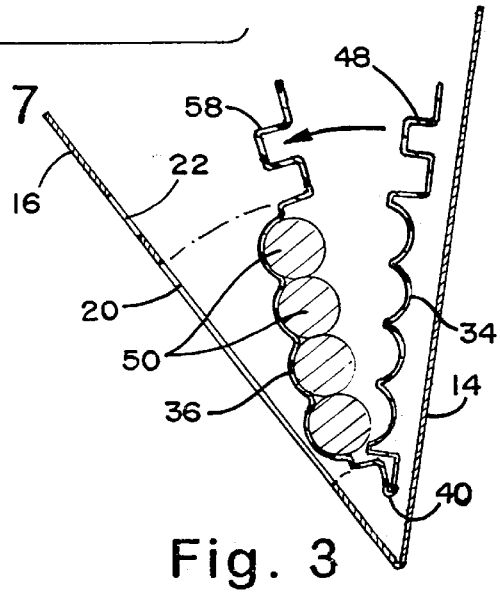
FIG. 3 is a cross-sectional exploded view taken through lines III—III of FIG. 1.

Referring to FIG. 3, the snap-fit closure 32 is further shown having a female receptacle 58 formed in the lid 36, and a male member 48 formed in the base housing 34 and engagable with the female receptacle 58 to provide an added interference fit closure to the merchandise container 30. The hinge 40 is also shown formed at the intersection of the base housing 34 and lid 36. Hinge 40 may be integrally formed of polymeric material during the thermoform blister forming process. Hinge 40 allows the lid 36 to pivot relative to base housing 34 between open and closed positions.

Figure 4:
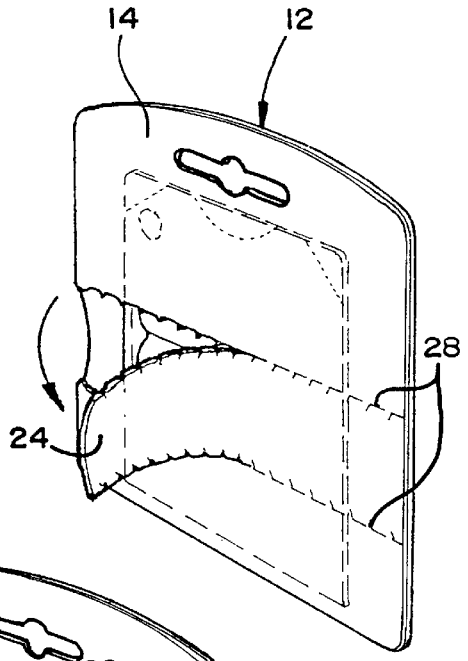
FIG. 4 is a rear perspective view of the battery package having a tear section, shown partially open, according to a first embodiment.

Turning to FIG. 4, the product display package 10 has a tear section formed in the rear layer 14 of display card 12 that allows a user to tear open the display card 12 to remove the merchandise container 30 therefrom. The tear section includes pull tab 24 and two parallel horizontal rows of perforations 28 formed in rear cardboard layer 14 between the left and right vertical edges of display card 12. The tab 24 is intended to be pulled away from rear layer 14 to tear along the perforations 28, as is partially shown.

Figure 5:
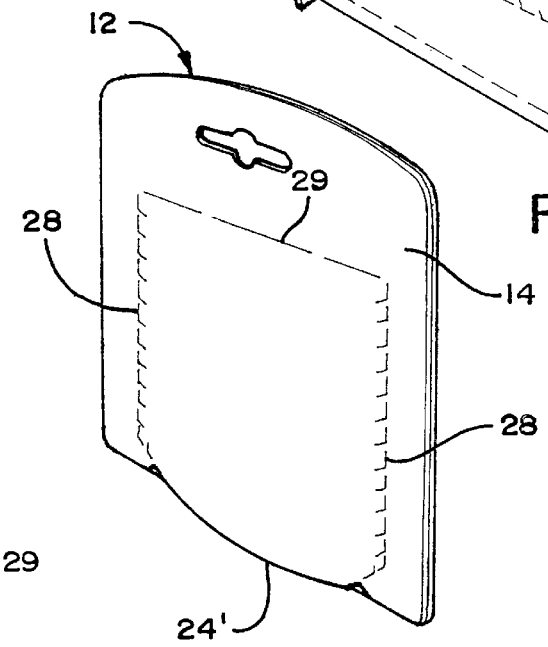
FIG. 5 is a rear perspective view of the battery package having a tear section according to a second embodiment.

Referring to FIG. 5, an alternate embodiment of the tear section is shown therein which includes a pull tab 24' extending from the lower edge. According to this embodiment, two parallel rows of perforations 28 are formed extending vertically from the lower edge of the rear layer 14 of display card 12 upward to a horizontal hinge line 29 as shown. Accordingly, tab 24' may be pulled outward to tear along perforations 28 up to hinge line 29 and may pivot along hinge line 29 to allow for the merchandise container 30 to be removed from display card 12.

Figure 6:
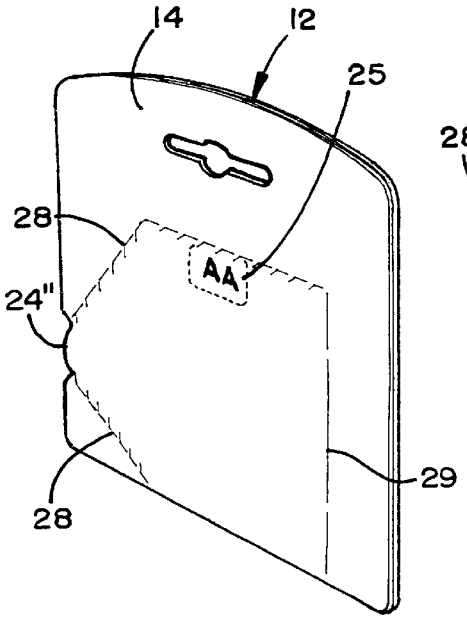
FIG. 6 is a rear perspective view of the battery package having a tear section according to a third embodiment.

Referring to FIG. 6, the display card 12 is further shown having a tear section according to yet a further embodiment. The third embodiment includes a pull tab 24" having perforations 28 that extends to and along a horizontal row and to the lower edge of the display card 12. The horizontal row of perforations 28 connects to a vertical hinge line 29. According to this embodiment, tab 24" may be opened by pulling tab 24" outward from the one vertical edge to the hinge line 29, to remove the merchandise container 30.

Also shown in FIG. 6 is a label 25 formed by perforations provided in tab 24". Label 25 is integrally formed in rear layer 14 of display card 12 and is bonded on the inside surface to merchandise container 30 via a heat seal, glue, or other adhesive. When tab 24" is torn from rear layer 14 of display card 12, label 25 is separated from tab 24" and remains bonded to merchandise container 30. Label 25 may contain print, such as "AA" which indicates the battery product type and size, or other information. Accordingly, label 25 serves as a print medium and also serves to fix the merchandise container to display card 12.

Figure 7:
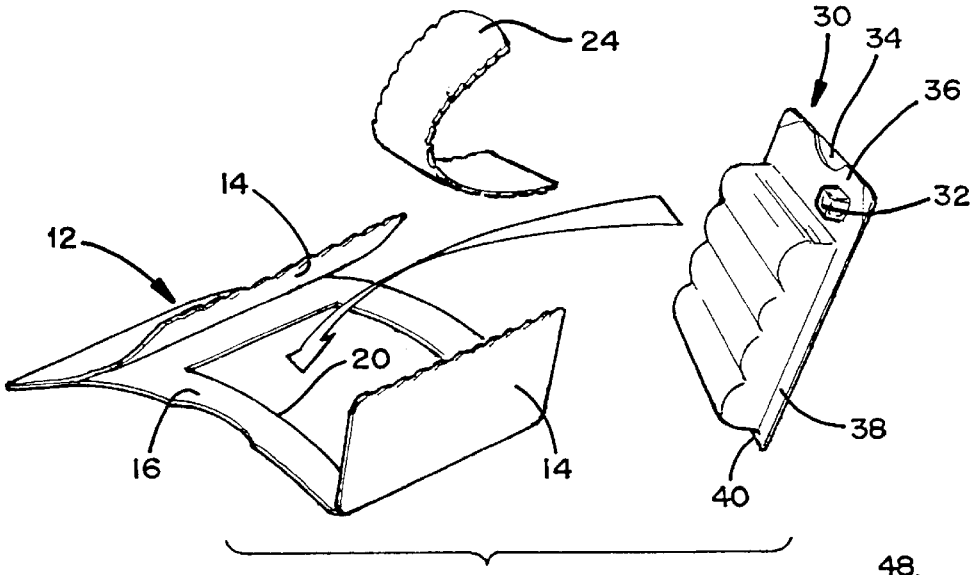
FIG. 7 is an exploded view of the battery package illustrating removal of the merchandise container from the display card.

The product display package 10 is further shown in FIG. 7 with the merchandise container 30 being removed from the display card 12. Tab 24 may be easily grasped by a user and torn along perforations 28 to remove tab 24 from display card 12. Once tab 24 is removed from display card 12, the remaining cardboard forming the rear layer 14 can be bent outwardly to release the merchandise container 30 and allow for removal of the reclosable merchandise container 30. Once removed, merchandise container 30 may be opened by pulling apart the base housing 34 from the lid 36 at the edge opposite hinge 40. Merchandise container 30 is reusable in that it may be opened and closed repeatedly to expose and contain product therein, while allowing for the display card 12 to be discarded.

The merchandise container 30 is further shown in greater detail in FIG. 8. Merchandise container 30 includes base housing 34 and lid 36 connected via an integrally formed hinge 40 that allows for pivoting of the lid 36 relative to the base housing 34. Housing 34 has a base member 42 with a substantially planar surface that is flush mounted against the rear layer 16 of display card 12. Integrally formed in the base member 42 is a generally rectangular upstanding wall 44 which defines a cavity with compartments 46 formed therein for receiving product, such as batteries 50.

The lid 36 has a partially planar member 55 with a generally rectangular recessed wall 54 that form molded upper compartments 56 which match compartments 46 to hold product therein. Compartments 56 form an outward protruding surface 52 which may generally conform to the size and shape of the product, such as batteries 50. The planar members 42 and 55 are intended to be flat against one another around the perimeter area when the merchandise container 30 is closed. In addition, the base housing 34 has a round, disk-like, protruding male member 48 adapted to fit into rectangular female receptacle 58 formed in lid 36. Together, the male member 48 and rectangular female receptacle 58 form the snap-fit closure 32. It should be appreciated that the upstanding wall 44 is generally rectangular and is adapted to be received by generally rectangular recessed wall 54 to form an interference fit closure of container 30. The addition of the snap-fit closure 32 provides an added means of closure and also serves as an identifier to let consumers know that merchandise container 30 is reclosable and reusable. The merchandise container 30 may be configured with the interference fit closure between the lower compartment 34 and upper lid 36, with or without the snap-fit closure 32.

An alternately configured snap-fit closure 32' is shown in FIGS. 9 and 10. Snap-fit closure 32' includes an elongated male member 48' integrally formed in the base housing 34 for engaging an elongated, substantially rectangular, female receptacle 58' formed in the lid 36. The alternate snap-fit closure 32' has an elongated length relative to its width. Male member 48' and female receptacle 58' are both generally rectangular with rounded corners and are configured so that male member 48' fits into female receptacle 58' to form an interference fit friction fitting.

Another embodiment of a closure for merchandise container 30 is illustrated in FIGS. 11 and 12. According to this embodiment, base housing 34 has a rectangular cutout 60 formed on an upper edge opposite the hinge edge, and a double sealed tab 62 is formed on the corresponding upper edge of lid 36. Double sealed tab 62 includes a pair of tabs 64 and 66 which are adapted to be bent into rectangular cutout 60 to engage the back surface of base housing 34.

Figure 14:
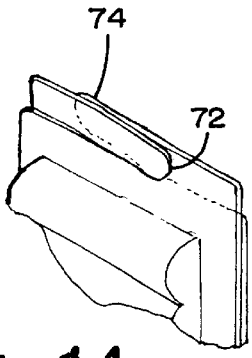
FIG. 14 is a partial perspective view of the closed merchandise container with the locking tab closure of FIG. 13.
Figure 13:
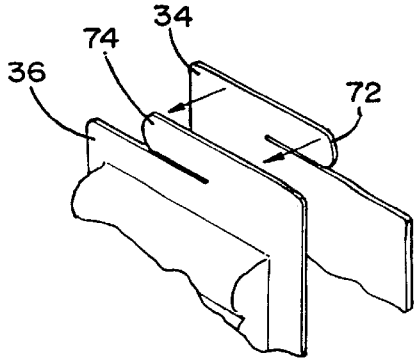
FIG. 13 is a partial perspective view of the open merchandise container with a locking tab closure according to yet another embodiment.

Referring to FIGS. 13 and 14, a further embodiment of a closure for merchandise container 30 is illustrated therein. According to this embodiment, a first tab 72 is integrally formed in an upper edge opposite the hinged edge of base housing 34, and a second tab 74 is formed along the corresponding upper edge of lid 36. Tabs 72 and 74 are adapted to matingly engage one another to provide a closure to merchandise compartment 30 as shown in FIG. 14.

Referring to FIG. 15, the assembly of product display package 10 is further illustrated therein. Package 10 may be assembled by disposing the reclosable merchandise container 30 in aperture 20 formed in the front layer 16 of display card 12, so that the peripheral flange 38 of merchandise container 30 rests on the inside surface of front layer 16 of display card 12. The rear layer 14 of display card 12 may include a separate sheet of cardboard or alternatively, may include the same sheet folded over about the lower edge. Layers 14 and 16 of display card 12 are bonded together with glue 52 provided therebetween. Glue 52 is preferably applied radially outside of the peripheral flange 38 of merchandise container 30, so that merchandise container 30 is loosely fit, yet sandwiched between layers 14 and 16 of display card 12. According to one example, glue 52 may include polyethylene bonded to one or both of cardboard layers 14 and 16, which allows the cardboard layers 14 and 16 of display card 12 to adhere to each other without adhering to the polymeric merchandise container. Polyethylene is commercially available and well-known for adhering cardboard layers together. Accordingly, reclosable merchandise container 30 may be easily removed from display card 12 when the tab 24 is torn to open the display card 12.

Figure 16:
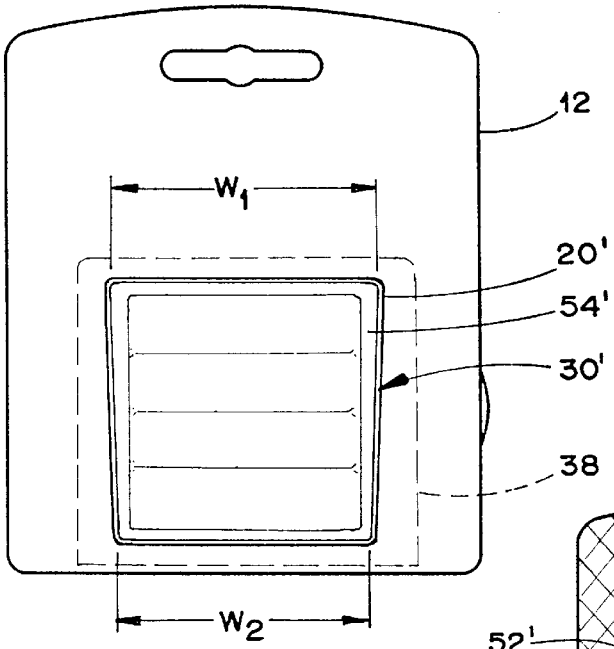
FIG. 16 is a front view of the battery package having a container housing in the shape of a trapezoid according to one embodiment.
Figure 17:
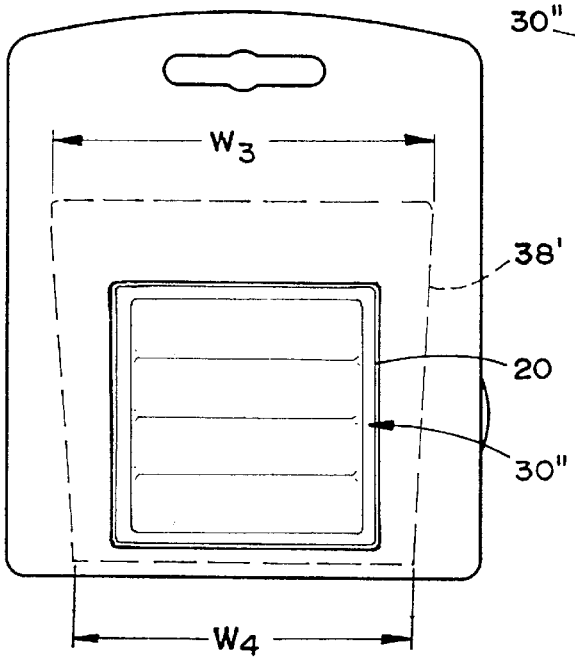
FIG. 17 is a front view of the product display package having a container with a trapezoid shaped flange according to another embodiment.
Figure 18:
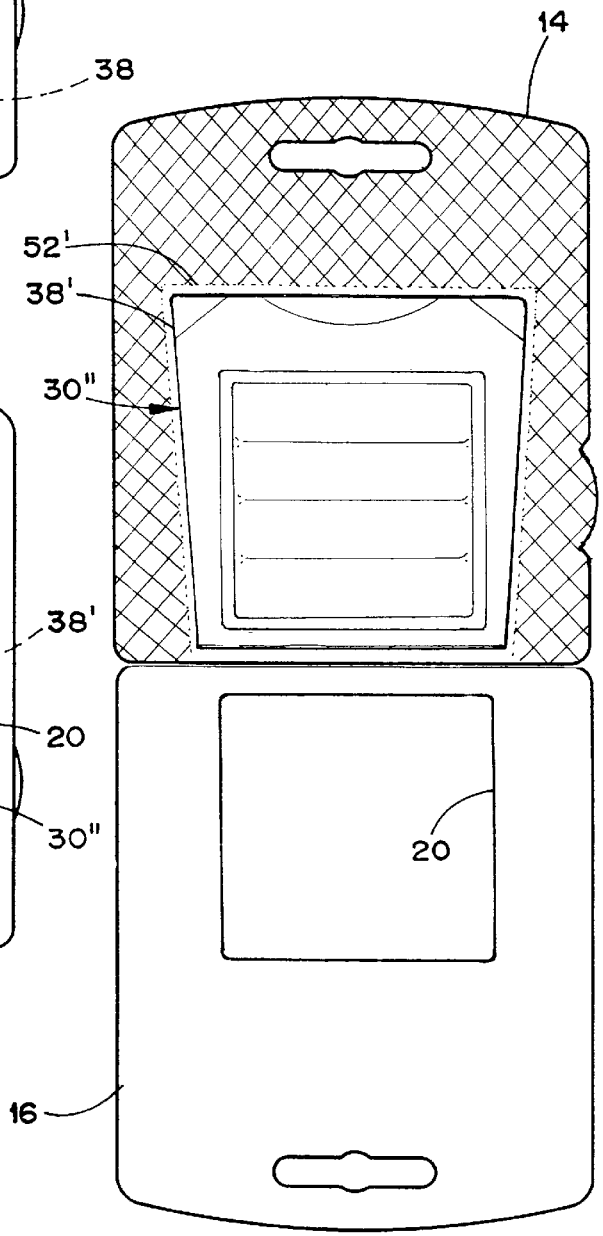
FIG. 18 is an assembly view illustrating the arrangement of the merchandise container and display card shown in FIG. 17.

Referring to FIGS. 16–18, the product display package 10 includes a polymeric merchandise container 30' having a trapezoid configuration that acts like a wedge with the display card 12 to prevent the merchandise container 30' from being released from the display card 12 due to the weight of product and/or abuse conditions. With particular reference to FIG. 16, merchandise container 30' has upstanding walls 44 and recessed walls 54' configured in a trapezoidal shape such that the upper end has a width $W_1$ that is greater than the width $W_2$ at the lower end. In addition, the front layer 16 of display card 12 has opening 20 configured with a substantially similarly shaped trapezoid that substantially matches the shape of walls 44 and 54', and has about the same width $W_1$ at the upper end being greater than the width $W_2$ at the lower end. Accordingly, the outer side of upstanding walls 44 and recessed walls 54' substantially fit the shape of the opening 20' formed in layer 16 of display card 12. By providing a trapezoidal shape, the merchandise container 30' is wedged against opening 20' in the event that merchandise container 30' is forced downward towards the lower edge. Accordingly, the wedge shaped opening provides an enhanced resistance to hold the merchandise container 30' in place relative to display card 12.

Referring to FIGS. 17 and 18, the merchandise container 30" has the peripheral flange 38' formed in a trapezoidal shape with a width $W_3$ at the upper end greater than the width $W_4$ at the lower end. With particular reference to FIG. 18, glue 52 is applied substantially perpendicular to and radially outward from the peripheral flange 38 such that the glue 52 outlines a non-glued trapezoid area. By employing a trapezoid shaped peripheral flange 38', merchandise container 30" is prevented from sliding excessively downward towards the lower edge of display card 10 due to the wedge configuration. In effect, when a downward force exists, the wedge shaped peripheral flange 38' is wedged closer into contact with the bond formed by glue 52, which thereby prevents merchandise container 30" from dropping out of display card 12.

Accordingly, the product display package 10 of the present invention advantageously provides for a reusable merchandise container 30 provided in a display card 12. A user may purchase the product display package 10 and easily remove the reclosable merchandise container 30 from the display card 12, and discard the display card 12. Thereafter, a user may repeatedly open and close the merchandise container 30 to store product(s) in the compact merchandise container 30.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A display package for retaining product, said package comprising:

a reclosable container having a housing defining a compartment adapted to house product and a closable lid fit to engage said housing and close said compartment, said container further having a member that varies in width such that an upper width is greater than a lower width;

a display card having a main body integrally formed to engage and support said container, said display card having an aperture formed therein for receiving said container; and a tear section formed in said display card and adapted to allow a user to tear open said display card to remove said container from said display card.

2. The package as defined in claim 1, wherein said container further comprises a peripheral flange extending outward from said container for engaging a channel in said display card.

3. The package as defined in claim 2, wherein said peripheral flange is the member that varies in width and has an upper width that is greater than a lower width.

4. The package as defined in claim 3, wherein said peripheral flange has a substantially trapezoidal shape.

5. The package as defined in claim 2, wherein said display card comprises a first layer of material attached to a second layer of material, said first layer of material having said aperture formed therein for receiving said container, and wherein said channel is provided between said first and second layers of material.

6. The package as defined in claim 1, wherein said tear section further comprises a tab adapted to allow a user to tear open the display card.

7. The package as defined in claim 1, wherein said tear section comprises one or more perforations formed in said display card.

8. The package as defined in claim 1, wherein said container comprises a thermoformed blister of polymeric material.

9. The package as defined in claim 8, wherein said container further comprises a hinge connecting said housing to said lid.

10. The package as defined in claim 1, wherein said display card comprises cardboard.

11. The package as defined in claim 1 further comprising an aperture formed in said display card adapted to allow said display card to be hung from a member for display.

12. The package as defined in claim 1, wherein said container houses one or more batteries.

13. The package as defined in claim 1, wherein each of said housing and said lid is generally rectangular and said display card comprises a generally planar main body.

14. The package as defined in claim 1, wherein said housing and said lid form the member that varies in width and has an upper width that is greater than a lower width.

15. The package as defined in claim 14, wherein said housing and said lid have a substantially trapezoidal shape.

16. The package as defined in claim 1, wherein said housing and said lid provide an interference fit closure.

17. The package as defined in claim 1, wherein said container further comprises a snap-fit closure assembly for holding said lid closed against said housing.

18. The package as defined in claim 17, wherein said snap-fit closure assembly comprises a female receptacle formed in one of said housing and lid, and a male member formed in the other of the housing and lid and adapted to interference fit with said female receptacle.

19. The package as defined in claim 18, wherein said snap-fit assembly is substantially rectangular.

20. A display package for retaining product, said package comprising:

a reclosable container having a housing defining a compartment adapted to house product and a closable lid fit to engage said housing and close said compartment, said container further having a peripheral flange formed outward from the container, wherein said container has a member that varies in width such that an upper width is greater than a lower width; and a display card having a main body and including a first layer of material attached to a second layer of material, said first layer of material having an aperture formed therein for receiving said container, wherein said flange of said container is disposed between said first and second layers of material to support the container.

21. The package as defined in claim 20, wherein said first and second layers of material of said display card are bonded to one another, and wherein said flange is sandwiched between said first and second layers without said bonding.

22. The package as defined in claim 20 further comprising a tear section formed in said display card to allow a user to open said display card to remove said container from said display card.

23. The package as defined in claim 22, wherein said tear section further comprises a tab adapted to allow a user to tear open said display card.

24. The package as defined in claim 22, wherein said tear section comprises one or more perforations formed in said display card.

25. The package as defined in claim 20, wherein said container comprises a thermoformed blister of polymeric material.

26. The package as defined in claim 25, wherein said container further comprises a hinge connecting said housing to said lid.

27. The package as defined in claim 20, wherein said display card comprises cardboard.

28. The package as defined in claim 20, wherein said container houses one or more batteries.

29. The package as defined in claim 20, wherein said container further comprises a snap-fit closure assembly for holding said lid closed against said housing.

30. The package as defined in claim 29, wherein said snap-fit closure assembly comprises a female receptacle formed in one of said housing and lid, and a male member formed in the other of said housing and lid and adapted to interference fit with said female receptacle.

31. The package as defined in claim 20, wherein said compartment and said lid are interference fit together to provide closure.

32. The package as defined in claim 20, wherein said peripheral flange is the member that varies in width and has an upper width that is greater than a lower width.

33. The package as defined in claim 32, wherein said peripheral flange has a substantially trapezoidal shape.

34. The package as defined in claim 20, wherein said housing and said lid form the member that varies in width and has an upper width that is greater than a lower width.

35. The package as defined in claim 34, wherein said housing and said lid have a substantially trapezoidal shape.

36. A display package for retaining product, said package comprising:

a container having a housing defining a compartment adapted to house product and a closable lid fit to engage said housing and close said compartment, said container further having a peripheral flange formed outward from said container, and wherein said container has a member that varies in width such that an upper width is greater than a lower width; and a display card having a main body and including a first layer of material attached to a second layer of material, said first layer of material having an aperture formed therein for receiving said container, wherein said flange of said container is disposed between said first and second layers of material to support the container.

37. The package as defined in claim 36, wherein said member comprises an upstanding wall of one of the housing and lid.

38. The package as defined in claim 37, wherein said housing has a substantially trapezoidal shape.

39. The package as defined in claim 36, wherein said member comprises said peripheral flange.

40. The package as defined in claim 39, wherein said peripheral flange has a substantially trapezoidal shape.

41. A battery package comprising:

a reclosable container having a housing defining a compartment adapted to house one or more batteries and a closable lid fit to engage said housing and close said compartment, said container further having a member that varies in width such that an upper width is greater than a lower width;

one or more batteries housed in said compartment; a display card having a main body integrally formed to engage and support said container, said display card further having an aperture formed therein for receiving said container; and a tear section formed in said display card and adapted to allow a user to tear open said display card to remove said container from said display card.

42. The battery package as defined in claim 41, wherein said container further comprises a peripheral flange extending outward from said container for engaging a channel in said display card.

43. The package as defined in claim 42, wherein said peripheral flange is the member that varies in width and has an upper width that is greater than a lower width.

44. The package as defined in claim 43, wherein said peripheral flange has a substantially trapezoidal shape.

45. The battery package as defined in claim 42, wherein said display card comprises a first layer of material attached to a second layer of material, said first layer of material having an aperture formed therein for receiving said container, and wherein said channel is provided between said first and second layers of material.

46. The battery package as defined in claim 41, wherein said tear section further comprises a tab and one or more perforations formed in said display card to allow a user to tear open the display card.

47. The battery package as defined in claim 42, wherein said container comprises a thermoformed blister of polymeric material.

48. The battery package as defined in claim 47, wherein said container further comprises a hinge connecting said container to said lid.

49. The battery package as defined in claim 41, wherein said display card comprises a generally planar main body made of cardboard.

50. The battery package as defined in claim 41, wherein said housing and said lid provide an interference fit closure.

51. The battery package as defined in claim 41, wherein said container comprises a snap-fit closure assembly for holding said lid closed against said housing.

52. The battery package as defined in claim 51, wherein said snap-fit closure assembly comprises a female receptacle formed in one of said housing and lid, and a male member formed in the other of the housing and lid and adapted to interference fit with the female receptacle.

53. The package as defined in claim 41, wherein said housing and said lid form the member that varies in width and has an upper width that is greater than a lower width.

54. The package as defined in claim 53, wherein said housing and said lid have a substantially trapezoidal shape.

55. A battery package comprising:

a reclosable container having a housing defining a compartment adapted to house one or more batteries therein and a closable lid fit to engage said housing and close said compartment, said container further having a peripheral flange formed outward around the container, wherein said container has a member that varies in width such that an upper width is greater than a lower width;

one or more batteries housed in said compartment; and a display card having a main body and including a first layer of material attached to a second layer of material, said first layer of material having an aperture formed therein for receiving said container, wherein said flange of said container is disposed between said first and second layers of material to support the container.

56. The battery package as defined in claim 55 further comprising a tear section formed in said display card to allow a user to open said display card to remove said container from said display card.

57. The battery package as defined in claim 56, wherein said tear section further comprises a tab and perforations to allow a user to open said display card.

58. The battery package as defined in claim 55, wherein said first and second layers of material of said display card are bonded to one another, and wherein said flange is sandwiched between said first and second layers without said bonding.

59. The battery package as defined in claim 55, wherein said container comprises a thermoformed blister of polymeric material.

60. The battery package as defined in claim 59, wherein said container comprises a hinge connecting said housing to said lid.

61. The battery package as defined in claim 55, wherein said display card comprises cardboard.

62. The battery package as defined in claim 55, wherein said container further comprises a snap-fit closure assembly for holding said lid closed against said housing.

63. The battery package as defined in claim 62, wherein said snap-fit closure assembly comprises a female receptacle formed in one of the housing and lid, and a male member formed in the other of said housing and lid and adapted to interference fit with said female receptacle.

64. The battery package as defined in claim 55, wherein said compartment and said lid are interference fit together.

65. The battery package as defined in claim 55, wherein said peripheral flange is the member that varies in width and has an upper width that is greater than a lower width.

66. The battery package as defined in claim 65, wherein said peripheral flange has a substantially trapezoidal shape.

67. The battery package as defined in claim 55, wherein said housing and said lid for the member that varies in width and has an upper width that is greater than a lower width.

68. The battery package as defined in claim 67, wherein said housing and said lid have a substantially trapezoidal shape.

69. The package as defined in claim 14, wherein the aperture formed in the display card varies in width such that an upper width is greater than a lower width.

70. The package as defined in claim 34, wherein the aperture formed in the display card varies in width such that an upper width is greater than a lower width.

71. The battery package as defined in claim 53, wherein the aperture formed in the display card varies in width such that an upper width is greater than a lower width.

72. The battery package as defined in claim 67, wherein the aperture formed in the display card varies in width such that an upper width is greater than a lower width.

* * * * *